US006156659A

United States Patent [19]

Roy

[11] Patent Number: 6,156,659

[45] Date of Patent: Dec. 5, 2000

[54] LINEAR CMP TOOL DESIGN WITH CLOSED LOOP SLURRY DISTRIBUTION

[75] Inventor: Sudipto Ranendra Roy, Singapore, Singapore

[73] Assignee: Chartered Semiconductor Manufacturing Ltd., Singapore, Singapore

[21] Appl. No.: 09/195,655

[22] Filed: Nov. 19, 1998

[51] Int. Cl.[7] ..... H01L 21/302

[52] U.S. Cl. ..... 438/692; 438/693; 451/259

[58] Field of Search ..... 438/689, 690, 438/691, 692, 693; 156/345; 451/259

[56] References Cited

U.S. PATENT DOCUMENTS

| | | | |
|---|---|---|---|
| 5,305,554 | 4/1994 | Emken et al. | 51/7 |
| 5,647,989 | 7/1997 | Hayashi et al. | 210/641 |
| 5,688,360 | 11/1997 | Jairath | 156/345 |
| 5,709,593 | 1/1998 | Guthrie et al. | 451/287 |
| 5,750,440 | 5/1998 | Vanell et al. | 438/692 |
| 5,755,614 | 5/1998 | Adams et al. | 451/60 |
| 5,775,983 | 7/1998 | Shendon et al. | 451/444 |
| 5,791,970 | 8/1998 | Yueh | 451/8 |
| 5,804,507 | 9/1998 | Perlov et al. | 438/692 |
| 5,827,115 | 10/1998 | Shimizu | 451/123 |

*Primary Examiner*—Benjamin Utech
*Assistant Examiner*—Kin-Chan Chen
*Attorney, Agent, or Firm*—George O. Saile; Rosemary L. S. Dike

[57] ABSTRACT

An apparatus for closed loop slurry distribution during semiconductor wafer polishing operations. The traditional peristaltic pump for slurry supply is eliminated thus eliminating irregularities in the conventional slurry supply. Common platform mounting of the slurry reservoir and the polishing apparatus resulting in concurrent and identical motion of the slurry supply reservoir and the polishing apparatus. The polishing medium is mounted on the outside of a cylinder as opposed to the conventional table mounting, the polishing medium rotates around the axis of the cylinder on which this polishing medium is mounted. The polishing pads are in direct physical contact with the slurry supply without the intervention of any slurry pumping arrangement.

12 Claims, 2 Drawing Sheets

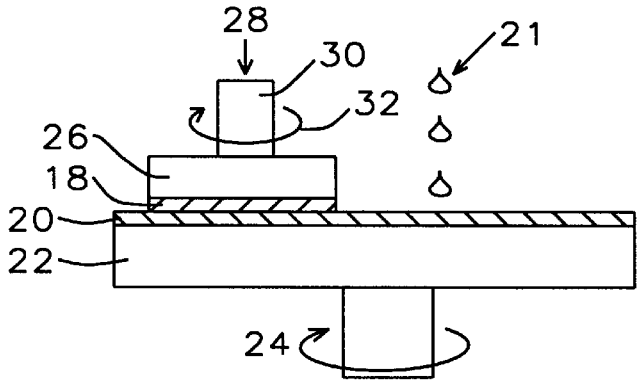
FIG. 1 – Prior Art
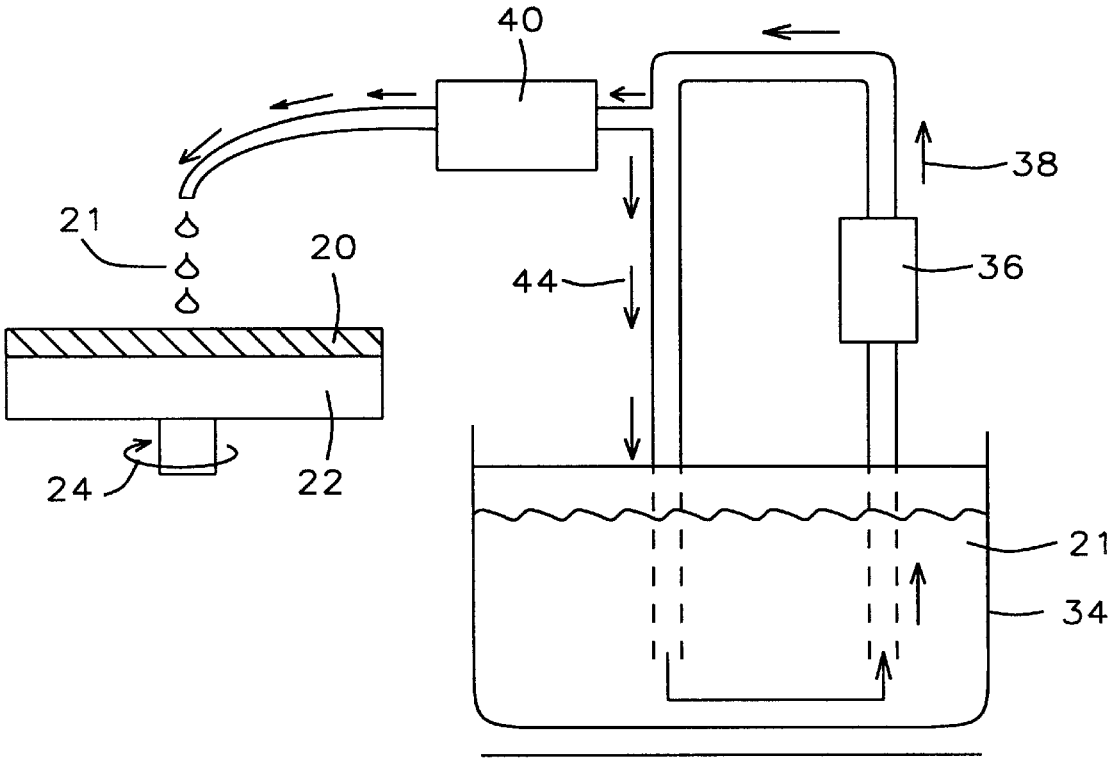
FIG. 2 – Prior Art

LINEAR CMP TOOL DESIGN WITH CLOSED LOOP SLURRY DISTRIBUTION

FIELD OF THE INVENTION

The present invention relates to the field of Chemical Mechanical Polishing (CMP). More particularly, the present invention relates to methods and apparatus for chemical mechanical polishing of substrates, such as semiconductor substrates, on a cylindrical rotating polishing pad in the presence of a chemically and/or physically abrasive slurry, and providing fresh supply of slurry, using a closed loop slurry supply system, onto the surface of polishing pad while the substrate is being polished.

DESCRIPTION OF THE PRIOR ART

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials therein, is maintained on the polishing pad to modify the polishing characteristics of the polishing pad in order to enhance the polishing of the substrate.

The use of chemical mechanical polishing to planarize semiconductor substrates has not met with universal acceptance, particularly where the process is used to remove high elevation features created during the fabrication of microelectronic circuitry on the substrate. One primary problem which has limited the used of chemical mechanical polishing in the semiconductor industry is the limited ability to predict, much less control, the rate and uniformity at which the process will remove material from the substrate. As a result, CMP is a labor-intensive process because the thickness and uniformity of the substrate must be constantly monitored to prevent overpolishing or inconsistent polishing of the substrate surface.

One factor, which contributes to the unpredictability and non-uniformity of the polishing rate of the CMP process, is the non-homogeneous replenishment of slurry at the surface of the substrate and the polishing pad. The slurry is primarily used to enhance the rate at which selected materials are removed from the substrate surface. As a fixed volume of slurry in contact with the substrate reacts with the selected materials on the surface of the substrate, this fixed volume of slurry becomes less reactive and the polishing enhancing characteristics of that fixed volume of slurry is significantly reduced. One approach to overcoming this problem is to continuously provide fresh slurry onto the polishing pad. This approach presents at least two problems. Because of the physical configuration of the polishing apparatus, introducing fresh slurry into the area of contact between the substrate and the polishing pad is difficult. Providing a fresh supply of slurry to all positions of the substrate is even more difficult. As a result, the uniformity and the overall rate of polishing are significantly affected as the slurry reacts with the substrate.

In the conventional approach, the wafer is held in a circular carrier, which rotates. The polishing pads are mounted on a polishing platen which has a flat surface and which rotates. The rotating wafer is brought into physical contact with the rotating polishing pad; this action constitutes the Chemical Mechanical Polishing process. Slurry is dispensed onto the polishing pad typically using a peristaltic pump. The excess slurry typically goes to a drain, which means that the conventional CMP process has an open loop slurry flow and therefore uses and dispenses with an excessive amount of slurry that adds significantly to the processing cost. There also is no method for exactly controlling slurry flow.

Since the wafer to be polished, which has a flat surface, and the polishing pad, which in the conventional approach is mounted on a flat polishing table, are both rotating, there exists a velocity differential across the surface of the wafer during the polishing operation. This velocity differential has a negative impact on wafer polishing uniformity and planarity which across the die and across the wafer. This limits the application of the conventional CMP approach especially in Shallow Trench Applications, copper damascene, etc., which are involved in sub-quarter micron technology modes.

FIG. 1 shows a Prior Art CMP apparatus. A polishing pad 20 is affixed to a circular polishing table 22 which rotates in a direction indicated by arrow 24 at a rate in the order of 1 to 100 m RPM. A wafer carrier 26 is used to hold wafer 18 face down against the polishing pad 20. The wafer 18 is held in place by applying a vacuum to the backside of the wafer (not shown). The wafer carrier 26 also rotates as indicated by arrow 32, usually in the same direction as the polishing table 22, at a rate on the order of 1 to 100 RPM. Due to the rotation of the polishing table 22, the wafer 18 traverses a circular polishing path over the polishing pad 20. A force 28 is also applied in the downward or vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26. Slurry 21 is deposited on top of the polishing pad 20.

FIG. 2 shows a typical Prior Art slurry delivery system. Slurry 21 of uniform chemical and mechanical composition is contained in the slurry vat 34 from where the slurry is pumped by the diaphragm pump 36 in direction 38. The peristaltic pump 40 deposits controlled and intermittent amounts of slurry 21 onto the polishing pad 20 while the balance 44 of the slurry that had been pumped by the diaphragm pump 36 is returned to the slurry vat 34. The rate at which the slurry 21 is provided by the two pumps 36 and 40 can be under control of conditions of operation and environment such as type of surface being polished, rate of rotation of either the wafer 18 and/or the polishing table 22, etc.

U.S. Pat. No. 5,775,983 (Shendon et al.) shows a conical roller pad.

U.S. Pat. No. 5,709,593 (Guthrie et al.) shows a method for slurry distribution. However, this reference differs from the present invention.

U.S. Pat. No. 5,791,970 (Yueh) shows a slurry recycling system.

U.S. Pat. No. 5,750,440 (Vanell et al.) teaches a method to mix slurry for CMP.

U.S. Pat. No. 5,305,554 (Emken et al.) shows a 'closed loop' moisture control system for a vibratory mass finishing system.

U.S. Pat. No. 5,688,360 (Jairath) shows a cylindrical conditioning pad and slurry distribution system.

SUMMARY OF THE INVENTION

The present invention teaches a closed loop slurry distribution system. The novelty of the present invention is that polishing pad is mounted on a rotating cylindrical platform that consists of a pad/core arrangement, instead of the conventional flat platform on which the polishing pads are placed. The cylindrical pad has motion in the X-Y-Z directions; the cylindrical pad in addition has rotational motion. The wafer that is being polished may also have an X-Y-Z motion in addition to the rotating motion.

The novelty of the present design consists of as unique pad/core design with the polishing pads mounted on the surface of a cylindrical core. The slurry is pumped in the conventional manner (for instance using diaphragm pumps) and flows through a linear reservoir that is placed such that the reservoir almost touches the cylindrical pad and is parallel to this pad. This arrangement assures that a smooth layer of slurry is maintained across the polishing pad. Using this approach allows for the complete elimination of the peristaltic pump which under present operating conditions causes drifts or irregularities in the flow of slurry to the polishing pad.

The primary objective of the present invention is to provide a chemical mechanical polishing apparatus that has uniform polishing rates across the surface of the die and the wafer.

Another objective of the present invention is to provide a closed loop slurry supply system thus reducing the cost of the chemical mechanical polishing process.

Yet another objective of the present invention is to eliminate the use of the peristaltic pump thus providing a steady and dependable supply of slurry to the polishing pad.

Yet another objective of the present invention is to eliminate the excessive use of slurry thus decreasing the cost of the chemical mechanical polishing.

Yet another objective of the present invention is to eliminate orbital motion across the surface of the die or wafer thus eliminating problems of polishing non-uniformity and planarity across these surfaces.

Yet another objective of the current invention is to provide means of metering the supply of slurry to the polishing pad.

BRIEF DESCRIPTION OF THE DRAWINGS

FIG. 1 shows a Prior Art CMP system.

FIG. 2 shows a Prior Art slurry delivery system.

DETAILED DESCRIPTION OF THE PREFERRED EMBODIMENT

Figure 3:
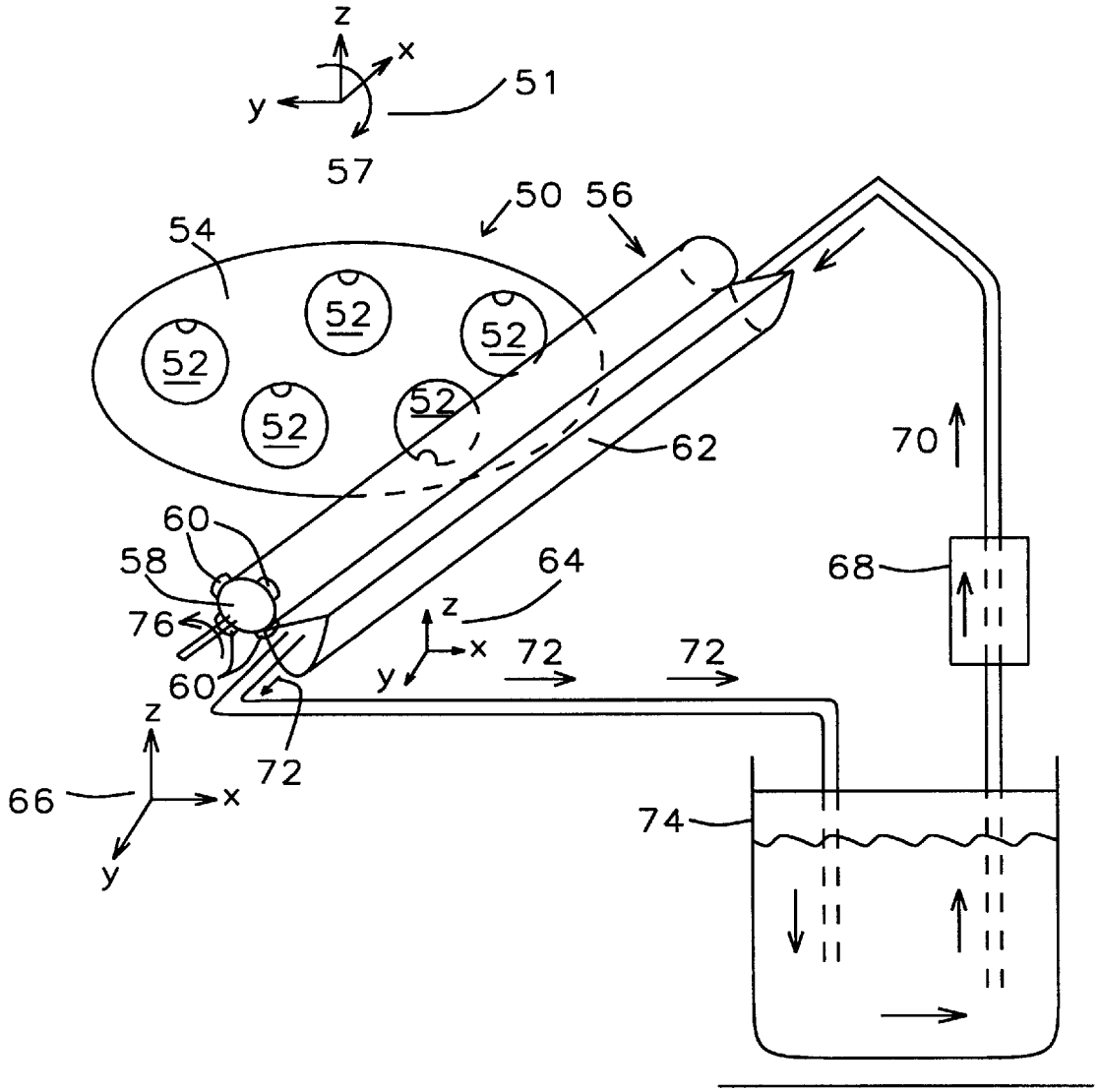
FIG. 3 shows an overview of the implementation of the present invention.

Referring now specifically to FIG. 3, there is shown an exploded view of the slurry distribution system of the present invention. The cross sectional view 50 in the top left corner of FIG. 3 shows the positioning of the wafers 52 that are being polished with respect to the wafer carrier 54. The diagram 51 above this cross sectional view indicates that the wafer carrier 54 has freedom of motion in the X-Y-Z direction in addition to the rotating motion 57.

The pad/core assembly 56 is further detailed in the center section of FIG. 3. Mounted on the outside of the core 58 and in parallel with this core is an arrangement of polishing pads 60. The number of polishing pads provided in this manner is not limited in number, any other number of pads can be used which best suits and satisfies the need of a particular application.

Adjacent to and below the pad/core assembly 56 is shown the slurry reservoir 62 which has, as indicated by diagram 66, freedom of motion in the X-Y-Z direction. The pad/core assembly 56 in addition has rotating motion 76. The pad/core assembly 56 and the slurry reservoir 62 are mounted on a common platform resulting in concurrent and identical motion of both the pad/core assembly 56 and the slurry reservoir 62. A conventional slurry pump 68 pumps the slurry in direction 70 into the slurry reservoir 62, gravitational overflow 72 of the slurry from the slurry reservoir 62 returns excess and spent slurry to the slurry supply reservoir 74.

A rotary driver (not shown) rotates the pad/core assembly 56 around its central axis. This rotary driver can be of conventional design; the design of the rotary driver is not part of the present invention. The wafers 52 that are to be polished are positioned on the wafer table 54 that rotates in the direction 57. The wafer table 54 is in close physical proximity with the core/pad assembly 56 such that the wafers 52 are in physical contact with the polishing pads 60. This physical contact between the polishing pad 60 and the wafers 52 combined with the rotational motions 57 and 76 of the wafer carrier 54 and the pad/core assembly 56 respectively constitutes the CMP process.

From the foregoing it will be clear that, although a specific embodiment of the present invention has been described herein for purposes of illustration, various modifications to the present invention may be made without deviating from the spirit and scope of the present invention. Accordingly, the present invention is not limited except as by the appended claims.

What is claimed is:

1. A method for the chemical mechanical planarization of semiconductor wafers, comprising:

providing a platform for mounting semiconductor wafers;

providing a means for rotating said platform for mounting semiconductor wafers;

providing a cylindrical platform for mounting semiconductor polishing pads whereby said cylindrical platform comprises a cylinder having a length mounted on a cylinder axis whereby furthermore said semiconductor polishing pads are of a concave construction with a concave inner surface said concave inner surface of said semiconductor polishing pads matching and having a contour identical to an outer surface of said cylindrical platform;

providing a means for rotating said cylindrical platform;

providing a means for evenly distributing slurry to a surface of said semiconductor polishing pads; and providing a means for controlling flow of slurry.

2. The method of claim 1 wherein said platform for mounting semiconductor wafers consists of a flat surfaced wafer carrier table.

3. The method of claim 1 wherein said polishing pads are mounted on an outside surface of said cylinder of said cylindrical platform and in a direction of the axis of said cylindrical platform and consist of one polishing pad while said polishing pad has a length that is equal to or approximately equal to the length of said cylinder.

4. The method of claim 1 wherein said polishing pad is mounted on an outside surface of said cylinder of said cylindrical platform and in a direction of the axis of said cylindrical platform and consists of a multiplicity of polishing pads while said polishing pads have a length which may or may not be uniform and is shorter than the length of said cylinder by a measurable amount.

5. The method of claim 1 wherein said polishing pads are mounted on an outside surface of said cylinder of said cylindrical platform and in a direction of the axis of said cylindrical platform and consist of a multiplicity of polishing pads while said polishing pads have a length that is equal to or about equal to the length of said cylinder.

6. The method of claim 1 wherein said polishing pads are mounted on an outside surface of said cylinder of said cylindrical platform and in a direction of the axis of said cylindrical platform and consist of a multiplicity of polishing pads while said polishing pads have a length which may or may not he uniform and which is shorter than the length of said cylinder by a measurable amount.

7. The method of claim 1 wherein said means of evenly distributing slurry along said cylindrical platform consists of the slurry reservoir combined with a slurry pump and slurry supply and drain tubing.

8. The method of claim 1 wherein the means of controlling the flow of slurry consists of gravitational overflow of said slurry reservoir.

9. The method of claim 1 wherein the means of delivering rotary motion to said wafer carrier consists of a rotary driver motor.

10. The method of claim 1 wherein the means of delivering rotary motion to said cylindrical platform consists of a rotary driver motor.

11. The method of claim 1 wherein in addition a means is provided for applying pressure by which the polishing pads are urged towards the semiconductor wafers.

12. The method of claim 1 with the addition of providing a non-abrasive refurbishing element and engaging said non-abrasive refurbishing element with the planarizing surface, wherein the non abrasive refurbishing element removes waste material from the planarizing surface without substantially altering the exposed abrasive particles at the planarizing surface.

* * * * *